US008081917B2

(12) United States Patent
Nakai et al.

(10) Patent No.: US 8,081,917 B2
(45) Date of Patent: Dec. 20, 2011

(54) IMAGE-BEARING MEMBER PROTECTING AGENT, PROTECTIVE LAYER FORMING DEVICE, PROCESS CARTRIDGE AND IMAGE FORMING APPARATUS

(75) Inventors: Hiroshi Nakai, Yokohama (JP); Masahide Yamashita, Tokyo (JP); Masato Iio, Yokohama (JP); Kunio Hasegawa, Isehara (JP); Shinya Tanaka, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 263 days.

(21) Appl. No.: 12/468,149

(22) Filed: May 19, 2009

(65) Prior Publication Data

US 2009/0285613 A1 Nov. 19, 2009

(30) Foreign Application Priority Data

May 19, 2008 (JP) ..... 2008-131272

(51) Int. Cl.
*G03G 21/00* (2006.01)

(52) U.S. Cl. ..... 399/346; 399/343; 430/126.2

(58) Field of Classification Search ..... 399/343, 399/346; 430/126.2
See application file for complete search history.

(56) References Cited

U.S. PATENT DOCUMENTS

| | | | | |
|---|---|---|---|---|
| 3,501,294 | A | 3/1970 | Joseph | |
| 2005/0152722 | A1 * | 7/2005 | Tawada et al. | 399/346 |
| 2007/0224528 | A1 | 9/2007 | Yamashita et al. | |
| 2008/0089726 | A1 | 4/2008 | Hatakeyama et al. | |
| 2008/0118286 | A1 | 5/2008 | Yamashita et al. | |
| 2008/0138132 | A1 | 6/2008 | Yamashita et al. | |
| 2008/0226365 | A1 | 9/2008 | Hatakeyama et al. | |
| 2008/0253801 | A1 | 10/2008 | Hatakeyama et al. | |
| 2009/0003853 | A1 | 1/2009 | Hatakeyama et al. | |
| 2009/0016769 | A1 | 1/2009 | Hatakeyama et al. | |
| 2009/0028618 | A1 | 1/2009 | Kabata et al. | |
| 2009/0196665 | A1 * | 8/2009 | Tanaka et al. | 399/346 |
| 2009/0279930 | A1 * | 11/2009 | Kabata et al. | 399/346 |

FOREIGN PATENT DOCUMENTS

| | | |
|---|---|---|
| JP | 51-22380 | 7/1976 |
| JP | 2002-97483 | 4/2002 |
| JP | 2005-171107 | 6/2005 |
| JP | 2005-274737 | 10/2005 |
| JP | 2006-350240 | 12/2006 |

* cited by examiner

*Primary Examiner* — Ryan Walsh

(74) *Attorney, Agent, or Firm* — Dickstein Shapiro LLP

(57) ABSTRACT

To provide an image-bearing member protecting agent used for forming a protective layer on a surface of an image bearing member, the agent including: a compressed powder body formed by pressurizing a powder containing at least a fatty acid metal salt (A) and an inorganic lubricant (B), wherein a ratio Db/Da of an average particle diameter Db of the inorganic lubricant (B) to an average particle diameter Da of the fatty acid metal salt (A) satisfies $0<Db/Da\leqq 0.40$.

7 Claims, 3 Drawing Sheets

IMAGE-BEARING MEMBER PROTECTING AGENT, PROTECTIVE LAYER FORMING DEVICE, PROCESS CARTRIDGE AND IMAGE FORMING APPARATUS

BACKGROUND OF THE INVENTION

1. Field of the Invention

The present invention relates to an image-bearing member protecting agent, a protective layer forming device, a process cartridge using the protective layer forming device, and an image forming apparatus using the process cartridge. More specifically, the present invention relates to a protective layer on the surface of a latent image bearing member to be uniformly charged, a device for forming the protective layer, a process cartridge using the device, and an image forming apparatus.

2. Description of the Related Art

In an electrophotographic process, an image is formed by subjecting a photoconductor, which is used as a latent image bearing member, to a charging step, a exposing step, a developing step, a transferring step.

Specifically, when a latent electrostatic image corresponding to image information has been formed after uniform charging of the photoconductor, the latent electrostatic image is made into a visible image with charged toner supplied from a developing device.

The visible image is transferred onto a transfer medium such as transfer paper, and subsequently made into an output image by being fixed on the transfer medium by means of fusing and penetrating actions obtained utilizing heat and pressure or solvent gas.

Developing devices are based upon either two-component developing methods using two-component developers in which toner is charged by agitating and mixing toner particles and carrier particles, or one-component developing methods using one-component developers in which charging is performed, for example, by frictional charging of toner itself without using carrier particles.

As already known, the one-component developing methods are classified into: magnetic one-component developing methods in which toner particles are held on development sleeves, which are used to supply developers, by magnetic force; and nonmagnetic one-component developing methods which do not utilize magnetic force.

The two-component developing methods are frequently used for copiers for which stable charge rising properties and chargeability of toner particles, and long-term stabilization of image quality are required, facsimile devices with copying functions, complex machines used with functions of printers and other functions combined together, etc., whereas the one-component developing methods are frequently used for compact printers and facsimile devices for which space saving and cost reduction are required.

Output images include not only single-color images such as monochrome images but also multicolor images such as full-color images, and demands for higher image quality have been increasing in recent years. Accordingly, in order to meet these demands, the quality of members used in image forming processes also needs to be maintained at a high level.

In each image forming apparatus, regardless of differences among the developing methods, while a photoconductor serving as an image bearing member for which a drum or belt is used is being moved by rotation or the like, the photoconductor is uniformly charged, a latent electrostatic image pattern is formed on the photoconductor by optical writing using a laser beam or the like, the latent electrostatic image pattern is visualized by a developing device, and the visible image is transferred onto a transfer medium so as to obtain an output image. Here, it should be noted that, in some cases, discharge products produced in the charging step and/or untransferred toner not transferred to the transfer medium are/is present on the photoconductor after the transfer of the visible image onto the transfer medium, or toner is attached to a background portion and thus present in positions not related to an image portion.

Accordingly, after the transferring step, the photoconductor is subjected to a cleaning step to remove the discharge products and/or the residual toner.

Among cleaning methods employed in the cleaning step, what is generally well known is a method of using a rubber blade which is inexpensive, has a simple structure and is superior in cleanability.

However, since the rubber blade removes residues present on the photoconductor surface by being pressed against the photoconductor surface, there is a great deal of stress caused by friction between the photoconductor surface and the rubber blade, and so the rubber blade is easily abraded. Additionally, as for an organic photoconductor used as a photoconductor against which a rubber blade is pressed, abrasion and scratches of photoconductor surface layer(s) arise, thereby shortening the lifetimes of the rubber blade and the organic photoconductor itself.

Moreover, in recent years, more and more toners used in image formation have been made smaller in particle size in response to demands for higher image quality.

In an image forming apparatus using a small particle size toner, the proportion of the toner leaking through a gap between a cleaning blade and the photoconductor surface is large; especially when the dimensional accuracy or attachment accuracy of the cleaning blade is inadequate, or the cleaning blade partially vibrates, leakage of the toner increases greatly. Thus, formation of a high-quality image is often hindered.

Thus, to lengthen the lifetime of an organic photoconductor and sustain high image quality over a long period of time, it is necessary to restrain deterioration of members, caused by friction, and thereby improve cleanability.

Conventional methods of reducing the friction include a method of forming a lubricant film on a photoconductor surface by supplying a lubricant onto the photoconductor surface and uniformly spreading the supplied lubricant with a cleaning blade.

As methods for forming lubricant films by supplying lubricant components, the following methods have been proposed.

There has been proposed a method of forming a lubricant film on a photoconductor surface by supplying the photoconductor surface with a solid lubricant composed mainly of zinc stearate (refer, for example, to Japanese Patent Application Publication (JP-B) No. 51-22380).

There has been proposed a method of maintaining lubricating performance by using a lubricant supply device that supplies a lubricant composed mainly of a higher alcohol having 20 to 70 carbon atoms, which allows the higher alcohol to stagnate on an end of a blade nip portion as particles that have no definite shape, and utilizing the appropriate wettability of the lubricant to the surface of an image bearing member (refer, for example, to Japanese Patent Application Laid-Open (JP-A) No. 2005-274737).

There has been proposed a method of sustaining smooth lubricating action over a long period of time by using powder of a specific alkylene bis alkyl acid amide compound as a lubricant component, which allows fine powder particles to be present on the interface between a cleaning blade and an image bearing member (refer, for example, to JP-A No. 2002-97483).

There has been proposed a method of reducing frictional force between an image bearing member and a cleaning member by supplying the photoconductor surface with lubricants prepared by adding inorganic lubricants to solid lubricants composed mainly of zinc stearate (refer, for example, to JP-A No. 2005-171107).

There has been proposed a method in which application of an image-bearing member protecting agent that contains a fatty acid metal salt and boron nitride makes it possible to maintain lubricating properties between a cleaning blade and an image bearing member by means of a lubricating effect of the boron nitride even under the influence of electric discharge performed in the vicinity of the image bearing member in a charging step, and leakage of toner is thereby prevented (refer, for example, to JP-A No. 2006-350240).

BRIEF SUMMARY OF THE INVENTION

Stress on a photoconductor used as an image bearing member includes not only stress caused by rubbing between the photoconductor and a cleaning blade in a cleaning step, but also electrical stress caused by electric discharge between the photoconductor and a charging device when the photoconductor is uniformly charged.

In a contact charging method which involves electric discharge on the surface of an image bearing member, and in a short-distance charging method in which a charging member is placed facing the surface of an image bearing member with a small amount of space provided in between, reaction products and active species such as ozone, produced on the surfaces of the image bearing members, adhere to the surfaces in some cases.

As to the method disclosed in JP-B No. 51-22380, it is possible to secure favorable lubricating properties and protection against abrasion on the surface of the image bearing member by evenly covering the surface with zinc stearate. In the case where the zinc stearate is used, however, since toner is liable to leak at an end of a cleaning blade used for cleaning, there are such troubles that an image is smeared with the toner that has leaked, a charging device is smeared and, moreover, the cleaning blade is abraded by the leakage of the toner.

As described above, in recent years, with a tendency that toners of small particle sizes and high sphericity are used for the purpose of achieving high image quality, toner leakage has become noticeable. Additionally, in some cases, along with the toner leakage, the zinc stearate leaks in large amounts.

If the zinc stearate that has leaked is attached to a member of the charging device and smears the member, it can cause charging unevenness, and thus there is such a trouble that an abnormal image, for example an image with uneven density, is formed.

As to the method disclosed in JP-A No. 2005-274737, the higher alcohol used in this method has high wettability to the surface of the image bearing member, and so an effect thereof as a lubricant can be expected; however, since the adsorption area occupied per molecule of the higher alcohol adsorbed onto the image bearing member tends to be large and so the density of molecules of the higher alcohol adsorbed per unit area of the image bearing member (the weight of the molecules adsorbed per unit area) tends to be small, a protective layer is easily damaged by the above-mentioned electrical stress and thus its effect of protecting the image bearing member is insufficient, which is problematic.

The method disclosed in JP-A No. 2002-97483 proposes a lubricant containing nitrogen atoms in its molecules; if an ion-dissociative compound classified as a nitrogen oxide or an ammonium-containing compound is produced as a decomposition product when the lubricant itself receives the above-mentioned electrical stress, the compound is taken into a lubricant layer, so that the lubricant layer has low resistance at high humidity, and thus blurring of an image is possibly caused.

The method disclosed in JP-A No. 2005-171107 proposes addition of fine particles of silica, titania, alumina, magnesia, zirconia, ferrite, magnetite and the like; however, mere addition of such inorganic lubricants cannot stabilize the consumption rate of the lubricants over a long period of time, so that the supply of the lubricants to the image bearing member may become inadequate with time, possibly causing filming of toner and/or paper powder, and cleaning failure.

As to the method disclosed in JP-A No. 2006-350240, when the boron nitride is used for the image-bearing member protecting agent, the boron nitride is difficult to remove from the surface of the image bearing member because of its high lubricating properties, and the boron nitride is attached onto the image bearing member as a film if excessively supplied. Therefore, in this method, securing a very stable supply of the boron nitride is vital.

The present invention is designed in light of the problems with the above-mentioned conventional image-bearing member protecting agents and image forming apparatuses using these agents, and an object of the present invention is to provide: an image-bearing member protecting agent capable of sustaining its performance of protecting the surface of an image bearing member over a long period of time and also capable of surely preventing the occurrence of abnormal images; and an image forming apparatus using the image-bearing member protecting agent.

More specifically, an object of the present invention is to provide: an image-bearing member protecting agent capable of protecting the surface of an image bearing member, preventing degradation of a cleaning member and leakage of toner, and further, preventing a member used for charging from being smeared, thereby preventing the occurrence of abnormal images over a long period of time; a protective layer forming device; and an image forming apparatus.

To achieve the above-mentioned object, the present invention includes the following elements.

(1) An image-bearing member protecting agent used for forming a protective layer on a surface of an image bearing member, the agent including: a compressed powder body formed by pressurizing a powder containing at least a fatty acid metal salt (A) and an inorganic lubricant (B), wherein a ratio Db/Da of an average particle diameter Db of the inorganic lubricant (B) to an average particle diameter Da of the fatty acid metal salt (A) satisfies $0<Db/Da\leqq 0.40$.

(2) The image-bearing member protecting agent according to (1), wherein the inorganic lubricant (B) is at least one selected from the group consisting of talc, mica, boron nitride and kaolin.

(3) The image-bearing member protecting agent according to one of (1) and (2), wherein the fatty acid metal salt (A) is zinc stearate.

(4) A protective layer forming device which applies or attaches an image-bearing member protecting agent onto a surface of an image bearing member, wherein the image-bearing member protecting agent is the image-bearing member protecting agent according to any one of (1) to (3).

(5) The protective layer forming device according to (4), including a supply member, wherein the image-bearing member protecting agent is supplied onto the surface of the image bearing member via the supply member.

(6) The protective layer forming device according to one of (4) and (5), further including a layer forming member whereby the image-bearing member protecting agent is pressed against the surface of the image bearing member and formed into a film.

(7) A process cartridge including: an image bearing member, the protective layer forming device according to any one of (4) to (6), and at least one of a charging device, a developing device and an image-bearing member cleaning device, which subject the image bearing member to an image forming process, wherein the protective layer forming device is provided in a post-cleaning position in the moving direction of the image bearing member.

(8) The process cartridge according to (7), wherein a blade member which is in contact with the image bearing member is used for the image-bearing member cleaning device.

(9) An image forming apparatus including: the process cartridge according to one of (7) and (8).

(10) The image forming apparatus according to (9), wherein the process cartridge is provided in a plurality of places so as to constitute color-by-color image forming stations.

According to the present invention, regarding a condition in which the protecting agent used on the image bearing member is formed, the protecting agent includes a compressed powder body formed by pressurizing a powder containing at least a fatty acid metal salt (A) and an inorganic lubricant (B), and a ratio Db/Da of an average particle diameter Db of the inorganic lubricant (B) to an average particle diameter Da of the fatty acid metal salt (A) satisfies $0<Db/Da\leqq0.40$; thus, temporal stability of the consumption of the protecting agent can be obtained. This makes it possible to sustain protection against abrasion on the surface of the image bearing member over a long period of time. Specifically, the fatty acid metal salt and the inorganic lubricant, used for the protecting agent, are closely bound together by the pressurized formation; by reducing gaps between particles, it is possible to prevent the particles from easily separating from one another when there are gaps between them, and thus to stabilize the consumption of the protecting agent.

As a result, it is possible to secure durability of the image bearing member due to the protective layer and thereby to prevent the occurrence of abnormal images.

DETAILED DESCRIPTION OF THE INVENTION

Figure 1:
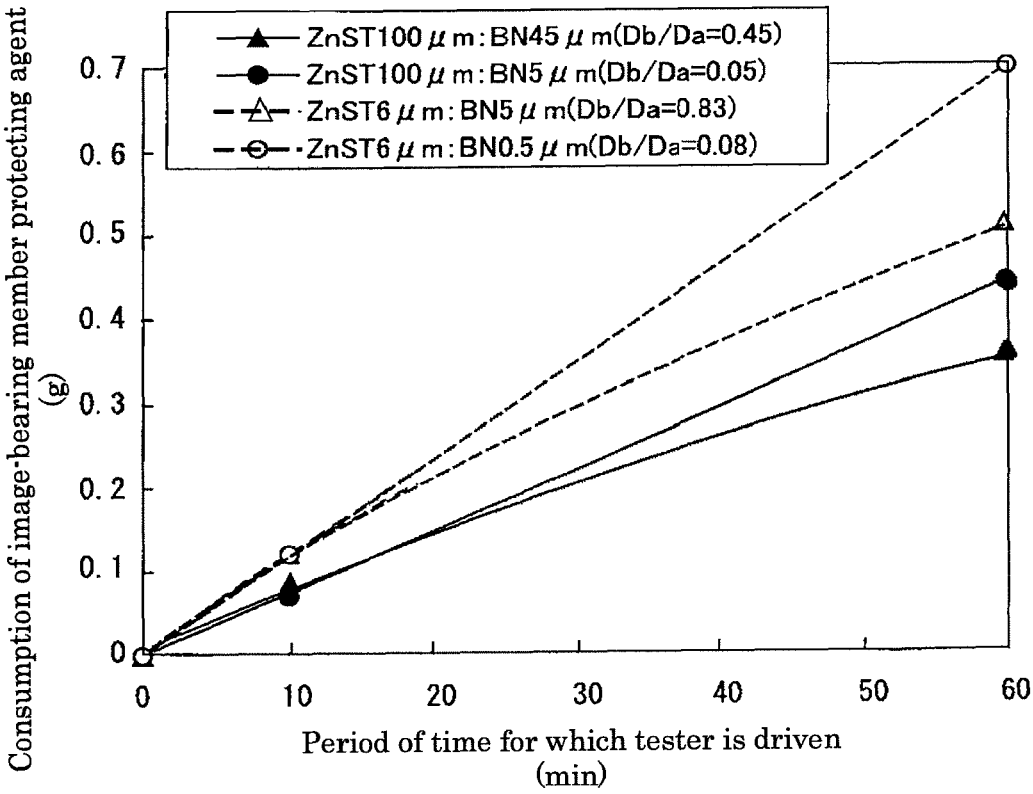
FIG. 1 is a line diagram for comparing characteristics of image-bearing member protecting agents according to the present invention.

The following explains the best mode for carrying out the present invention, referring to the drawings.

First of all, an explanation of an image-bearing member protecting agent according to the present invention is given. An image-bearing member protecting agent according to the present invention includes a compressed powder body formed by pressurizing a powder containing at least a fatty acid metal salt (A) and an inorganic lubricant (B), wherein a ratio Db/Da of an average particle diameter Db of the inorganic lubricant (B) to an average particle diameter Da of the fatty acid metal salt (A) satisfies $0<Db/Da\leqq0.40$.

For the fatty acid metal salt (A), the following substances may be used.

Barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate and cadmium ricinoleate may be used. However, the fatty acid metal salt (A) is not limited to these individual substances; for example, these substances may be used in combination. In the present invention, zinc stearate is used on the grounds that it has superior film-forming properties particularly on an image bearing member.

Meanwhile, for the inorganic lubricant (B), the following substances may be used. Note that the inorganic lubricant (B) herein mentioned means an inorganic compound which exhibits lubricating properties by being cleft or which induces internal lubricating action.

Specific examples of substances that may be used therefor include, but are not limited to, talc, mica, boron nitride, molybdenum disulfide, tungsten disulfide, kaolin, smectite, hydrotalcite compounds, calcium fluoride, graphite, plate-like alumina, sericite and synthetic mica. Take boron nitride for example. Boron nitride is a substance in which hexagonal lattice planes formed by firmly bonded atoms are stacked on top of one another with sufficient space between each and thus weak van der Waals force is the only force which acts between layers; therefore, the layers are easily separated from one another and lubricating properties are exhibited. Additionally, these inorganic lubricants may be surface-treated, if necessary, so as to be hydrophobized, for example.

The image-bearing member protecting agent according to the present invention is composed of a compressed powder body formed by pressurizing a powder containing at least the fatty acid metal salt (A) and the inorganic lubricant (B).

To protect the image bearing member, it is necessary to supply a fixed amount of the image-bearing member protecting agent onto the image bearing member, with the agent being sufficiently uniform in size, using a protecting agent supply member. Also, in terms of simplicity of use, it is desirable that the image-bearing member protecting agent be processed into solid form rather than kept in powder form. For that reason, in the present invention, the image-bearing member protecting agent is composed of a compressed powder body formed by pressurizing protecting agent raw materials in powder form.

The image-bearing member protecting agent of the present invention produced as described above is formed into a film by being uniformly spread, etc. at the same time or after it is attached onto the surface of the operating image bearing member in an image forming apparatus, and a uniformly spread protective layer is thus formed.

If the film formation is insufficient, it is difficult to protect the image bearing member from electrical stress in a step of charging the image bearing member. Accordingly, what is required for the protective layer is film formation which is sufficient to protect the surface of the image bearing member from discharge products and active species such as ozone produced when the image bearing member is charged.

Parenthetically, in order to form a protective layer which can surely secure protection for the image bearing member, it is necessary to supply an adequate amount of the image-bearing member protecting agent onto the surface of the image bearing member; in the case where the agent is grazed by a rubbing member such as a brush and thusly supplied onto the surface of the image bearing member, the supply of the agent depends largely upon the hardness of the agent.

In the case where the image-bearing member protecting agent is used in solid form, the supply of the agent depends largely upon the mechanical properties of materials used for the agent, so that when an attempt is made to secure an adequate supply of the agent, the agent has to be soft.

When the image-bearing member protecting agent is soft, foreign matter such as transfer residual toner is attached to or buried in the surface of the agent to be supplied, possibly causing temporal variation in the supply of the agent or supply failure, and thus the surface of the image bearing member cannot be stably protected over a long period of time.

In the image-bearing member protecting agent according to the present invention, the ratio Db/Da of the average particle diameter Db of the inorganic lubricant (B) to the average particle diameter Da of the fatty acid metal salt (A) is set in such a manner as to satisfy $0<Db/Da\leqq 0.40$, thereby solving such problems.

In the present invention, since these materials are pressurized to form the compressed powder body, the maximum diameter of each particle is desirably 500 μm or less; when the diameter is greater than 500 μm, there is a decrease in the formability of the compressed powder body. Therefore, it is desirable that the upper limit of the particle diameter of the fatty acid metal salt (A) be 500 μm. Meanwhile, it is desirable that the lower limit of the particle diameter of the inorganic lubricant (B) be approximately 0.07 μm because if the inorganic lubricant (B) is too small in particle diameter, it exhibits poor lubricating properties.

Thus, in the present invention, it is desirable that the actual lower limit of the value of Db/Da be approximately 0.0014. The "average particle diameter" mentioned in the present invention can be calculated using a known method; in general, in view of the relevant particle diameter range and the relevant measurement accuracy, a laser diffraction particle size distribution measuring apparatus is preferably used.

Also in the present invention, the mass ratio Mb/Ma of the inorganic lubricant (B) to the fatty acid metal salt (A) contained is preferably in the range of 1/1 to 1/99, more preferably in the range of 1/1 to 5/95. Since addition of a small amount of the inorganic lubricant (B) can produce a significant effect on lubricating properties, the inorganic lubricant (B) need not be excessively contained; also, if the amount of the inorganic lubricant (B) contained is very large, the compressed powder body becomes very hard when formed, and thus it becomes difficult to supply the compressed powder body onto the image bearing member.

Examinations carried out by the present inventors have revealed that the stability of the supply of the image-bearing member protecting agent containing the fatty acid metal salt depends largely upon the ratio of the particle diameter of the inorganic lubricant (B) to the particle diameter of the fatty acid metal salt (A).

The following describes an experimental result.

FIG. 1 shows the consumption of image-bearing member protecting agents with respect to the period of time for which a tester is driven, in a test where each image-bearing member protecting agent, formed by pressurizing a mixture in which zinc stearate (ZnST) and boron nitride (BN) are mixed together with the mass ratio of the zinc stearate to the boron nitride being 8:2, is continuously supplied onto an image bearing member, using a brush-like supply member. Here, for comparison, different particle diameters are employed for each of the zinc stearate and the boron nitride.

As to the ratio of the particle diameter of the boron nitride to the particle diameter of the zinc stearate, in the line diagram of FIG. 1, the ratios related to the lines plotted with circles are within the range of the present invention, whereas the ratios related to the lines plotted with triangles are outside the range of the present invention.

As can be understood from the line diagram of FIG. 1, only when the ratios are within the range of the present invention, the plotted lines exhibit linearity, in other words temporal stability of the consumption can be achieved.

Although it is not possible to identify the exact cause of the phenomenon, it is inferred that when particles of the boron nitride are dispersed between large particles of the zinc stearate and compressed, the particles of the boron nitride enter gaps between the particles of the zinc stearate, and that there is an appropriate diameter range for the particles of the boron nitride to fill these gaps and temporal variation in consumption is reduced when these gaps are evenly filled. It is inferred that due to such an effect, it is possible in the present invention to obtain stable images over a long period of time.

The image-bearing member protecting agent according to the present invention is formed by a dry formation method that is among powder formation methods, as the agent is advantageous in terms of simplicity of use, etc. when formed into a predetermined shape, for example a prismatic or columnar shape.

A uniaxial pressing formation method as a typical example of the dry formation method can be performed, broadly in accordance with the following procedure.

<<1>> A predetermined amount of an image-bearing member protecting agent raw material powder which has been processed into powder and classified so as to have a certain particle diameter is weighed.

<<2>> The weighed image-bearing member protecting agent raw material powder is poured into a mold having a predetermined shape.

<<3>> The poured powder is pressurized using a pressing die so as to produce a compressed powder body having a specific interconnected cell rate and a specific closed cell rate.

The compressed powder body is removed from the mold, and an image-bearing member protecting agent porous compact is thus produced.

<<4>> Thereafter, the shape of the image-bearing member protecting agent may be adjusted by cutting, for example.

It should, however, be noted on this occasion that pressing a heating element onto the surface of the agent so as to increase smoothness of the surface is unfavorable because protecting agent particles on the surface fuse with one another and become coarse.

Additionally, if necessary, the bonding force at interfaces of the raw material powder may be adjusted by naturally or slowly cooling the compressed powder body after curing it at a predetermined temperature for a certain period of time.

It should, however, be noted that extreme temperatures and long-time curing are unfavorable because the bond between the particles is made firm and the compressed powder body is brought into an overly sintered state.

If the sintering excessively proceeds, interconnected cells are enclosed and change to closed cells inside the protecting agent compact. Accordingly, by specifying the proportion of the closed cells as mentioned above, it is possible to estimate the extent of the bonding force between the particles and thus to prevent excessive sintering and produce a protecting agent compact in which favorable brittleness is surely maintained.

For the mold, a metal mold made, for example, of steel, stainless steel or aluminum is preferable in terms of dimensional accuracy and heat conductivity. Additionally, the inner wall surface of the mold may be coated with a release agent, for example a tiny amount of fluorine resin or silicone resin, to enhance separability.

Figure 2:
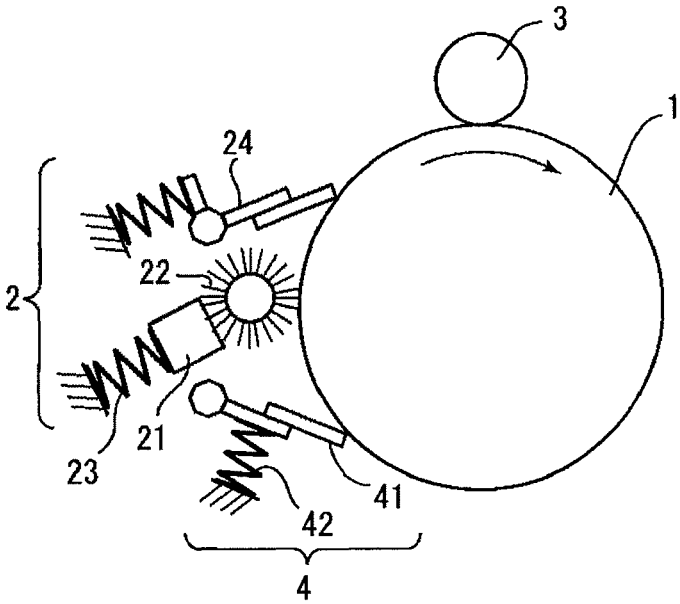
FIG. 2 is a drawing showing a structure used in forming a protective layer, utilizing a protecting agent bar according to the present invention.

An image-bearing member protecting agent 21 thus obtained is supplied onto the surface of an image bearing member, using a protective layer forming device shown in FIG. 2, and a film layer is uniformly formed on the surface of the image bearing member. The following explains the protective layer forming device.

FIG. 2 is a schematic drawing showing a protective layer forming device.

In FIG. 2, a protective layer forming device 2, provided facing a photoconductor drum 1 serving as an image bearing member, is mainly composed of an image-bearing member protecting agent 21, a protecting agent supply member 22, a pressing force providing mechanism 23, a protective layer forming mechanism 24, etc.

The image-bearing member protecting agent 21 according to the present invention constitutes a protecting agent bar in the form of a block and is brought into contact with the protecting agent supply member 22 in the form of a brush or the like by the pressing force of the pressing force providing mechanism 23.

Rotating at a linear velocity different from that of the photoconductor drum 1, the protecting agent supply member 22 can rub on the drum surface, and at this time an image-bearing member protecting agent held on the surface of the protecting agent supply member 22 is supplied onto the surface of the image bearing member.

In some cases, the image-bearing member protecting agent supplied onto the surface of the photoconductor drum 1 does not sufficiently form into a protective layer when supplied, depending upon the selection of materials; in order for a protective layer to be formed more uniformly, the agent is formed into a thinner layer by a protective layer forming mechanism having a blade-like member or the like and thusly made into an image-bearing member protecting layer.

The material of a blade used for the protective layer forming mechanism 24 is not particularly limited, and examples of the material include elastic materials such as urethane rubber, hydrin rubber, silicone rubber and fluorine rubber, which are generally known as materials for cleaning blades. These elastic materials may be used individually or in a blended manner. Additionally, a portion of such a rubber blade which comes into contact with the image bearing member may be coated or impregnated with a low friction coefficient material. Further, in order to adjust the hardness of the elastic material used, a filling material such as an organic or inorganic filler may be dispersed.

Such a blade is fixed to a blade support by a method such as adhesion or fusion bonding so that an end of the blade can be pressed onto the surface of the image bearing member. Although the thickness of the blade cannot be unequivocally defined because the thickness is decided in view of the force applied when the blade is pressed, preference is generally given to approximately 0.5 mm to 5 mm, and greater preference is given to approximately 1 mm to 3 mm.

Similarly, although the length of the blade which protrudes from the blade support and may bend (so-called free length) cannot be unequivocally defined because the length is decided in view of the force applied when the blade is pressed, preference is generally given to approximately 1 mm to 15 mm, and greater preference is given to approximately 2 mm to 10 mm.

Another structure of a blade member for forming a protective layer may be employed in which a layer of resin, rubber, an elastomer, etc. is formed over a surface of an elastic metal blade such as a spring plate, using a coupling agent, a primer component, etc. if necessary, by a method such as coating or dipping, then subjected to thermal curing, etc. if necessary, and further, subjected to surface polishing, etc. if necessary.

As for the thickness of the elastic metal blade, preference is given to approximately 0.05 mm to 3 mm, and greater preference is given to approximately 0.1 mm to 1 mm.

In order to prevent the elastic metal blade from being twisted, the blade may, for example, be bent in a direction substantially parallel to a support shaft after the installation of the blade.

As the material for the surface layer, a fluorine resin such as PFA, PTFE, FEP or PVdF, a fluorine-based rubber, a silicone-based elastomer such as methylphenyl silicone elastomer, or the like may be used with the addition of a filler if necessary. However, the material is not limited thereto.

In FIG. 2, the force with which the protective layer forming mechanism 24 presses against the photoconductor drum 1 that is an image bearing member is sufficient as long as it allows the image-bearing member protecting agent 21 to spread and form into a protective layer or a protective film. The force is preferably in the range of 5 gf/cm to 80 gf/cm, more preferably in the range of 10 gf/cm to 60 gf/cm, as a linear pressure.

A brush-like member is preferably used as the protecting agent supply member 22; in this case, brush fibers of the brush-like member preferably have flexibility to reduce mechanical stress on the surface of the image bearing member.

As the material for the flexible brush fibers, one or more generally known materials may be used. Specifically, resins having flexibility among the following materials may be used: polyolefin resins (e.g. polyethylene and polypropylene); polyvinyl resins and polyvinylidene resins (e.g. polystyrene, acrylic resins, polyacrylonitrile, polyvinyl acetate, polyvinyl alcohol, polyvinyl butyral, polyvinyl chloride, polyvinyl carbazole, polyvinyl ethers and polyvinyl ketones); vinyl chloride-vinyl acetate copolymers; styrene-acrylic acid copolymers; styrene-butadiene resins; fluorine resins (e.g. polytetrafluoroethylene, polyvinyl fluoride, polyvinylidene fluoride and polychlorotrifluoroethylene); polyesters; nylons; acrylics; rayon; polyurethanes; polycarbonates; phenol resins; amino resins (e.g. urea-formaldehyde resins, melamine resins, benzoguanamine resins, urea resins and polyamide resins); and so forth.

To adjust the extent to which the brush bends, diene-based rubber, styrene-butadiene rubber (SBR), ethylene propylene rubber, isoprene rubber, nitrile rubber, urethane rubber, silicone rubber, hydrin rubber, norbornene rubber and the like may be used in combination.

A support for the protecting agent supply member 22 may be a stationary support or a roll-like rotatable support. The roll-like support for the supply member is exemplified by a roll brush formed by spirally winding a tape with a pile of brush fibers around a metal core. Each brush fiber preferably has a diameter of approximately 10 μm to 500 μm and a length of 1 mm to 15 mm, and the number of the brush fibers is preferably 10,000 to 300,000 per square inch ($1.5\times10^7$ to $4.5\times10^8$ per square meter).

For the protecting agent supply member 22, use of a material having a high brush fiber density is highly desirable in terms of uniformity and stability of the supply; for example, it is desirable that one fiber be formed from several to several hundreds of fine fibers. More specifically, 50 fine fibers of 6.7 decitex (6 denier) may be bundled together and planted as one fiber, as exemplified by the case of 333 decitex=6.7 decitex× 50 filaments (300 denier=6 denier×50 filaments).

Additionally, if necessary, the brush surface may be provided with a coating layer for the purpose of stabilizing the shape of the brush surface, the environment, etc. As constituent(s) of the coating layer, use of constituent(s) capable of deforming in a manner that conforms to the bending of the brush fibers is preferable, and the constituent(s) is/are not limited in any way as long as it/they can maintain its/their flexibility. Examples of the constituent(s) include polyolefin resins such as polyethylene, polypropylene, chlorinated polyethylene and chlorosulfonated polyethylene; polyvinyl resins and polyvinylidene resins, such as polystyrene, acrylics (e.g. polymethyl methacrylate), polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; silicone resins including organosiloxane bonds, and modified products thereof (e.g. modified products made of alkyd resins, polyester resins, epoxy resins, polyurethanes, etc.); fluorine resins such as perfluoroalkyl ethers, polyfluorovinyl, polyfluorovinylidene and polychlorotrifluoroethylene; polyamides; polyesters; polyurethanes; polycarbonates; amino resins such as urea-formaldehyde resins; epoxy resins; and combinations of these resins.

An image-bearing member protecting agent which has degraded is removed along with other components such as toner remaining on the photoconductor drum 1 serving as an image bearing member, by a cleaning mechanism 4 that is an ordinary cleaning mechanism.

The protective layer forming mechanism 24 may function also as the cleaning mechanism 4; however, since the function of removing residual matter on the surface of the image bearing member (photoconductor drum) and the function of forming a protective layer often require different appropriate rubbed states of a member, these functions are preferably separated from each other, and the cleaning mechanism 4 composed of a cleaning member 41, a cleaning pressing mechanism 42, etc. is preferably provided on the upstream side of the protecting agent supply member 22 as shown in FIG. 2.

Figure 3:
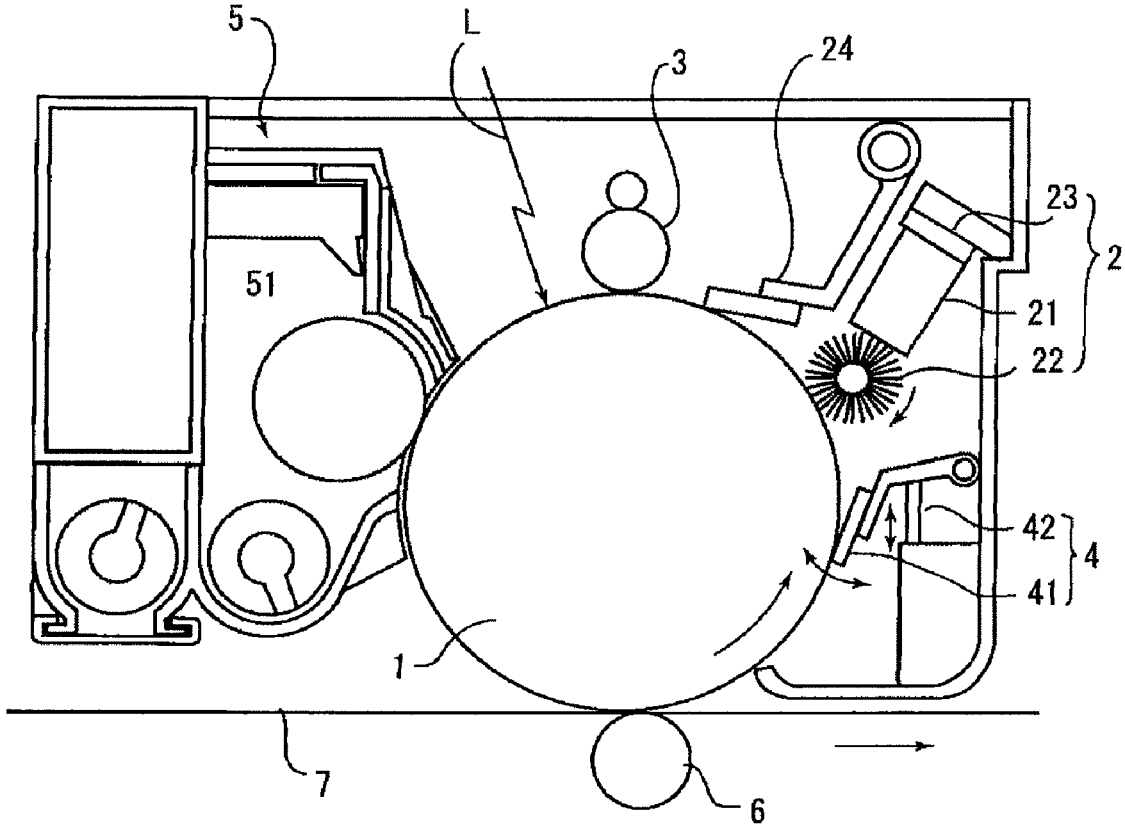
FIG. 3 is a drawing for explaining a process cartridge used in the image forming apparatus shown in FIG. 4.
Figure 4:
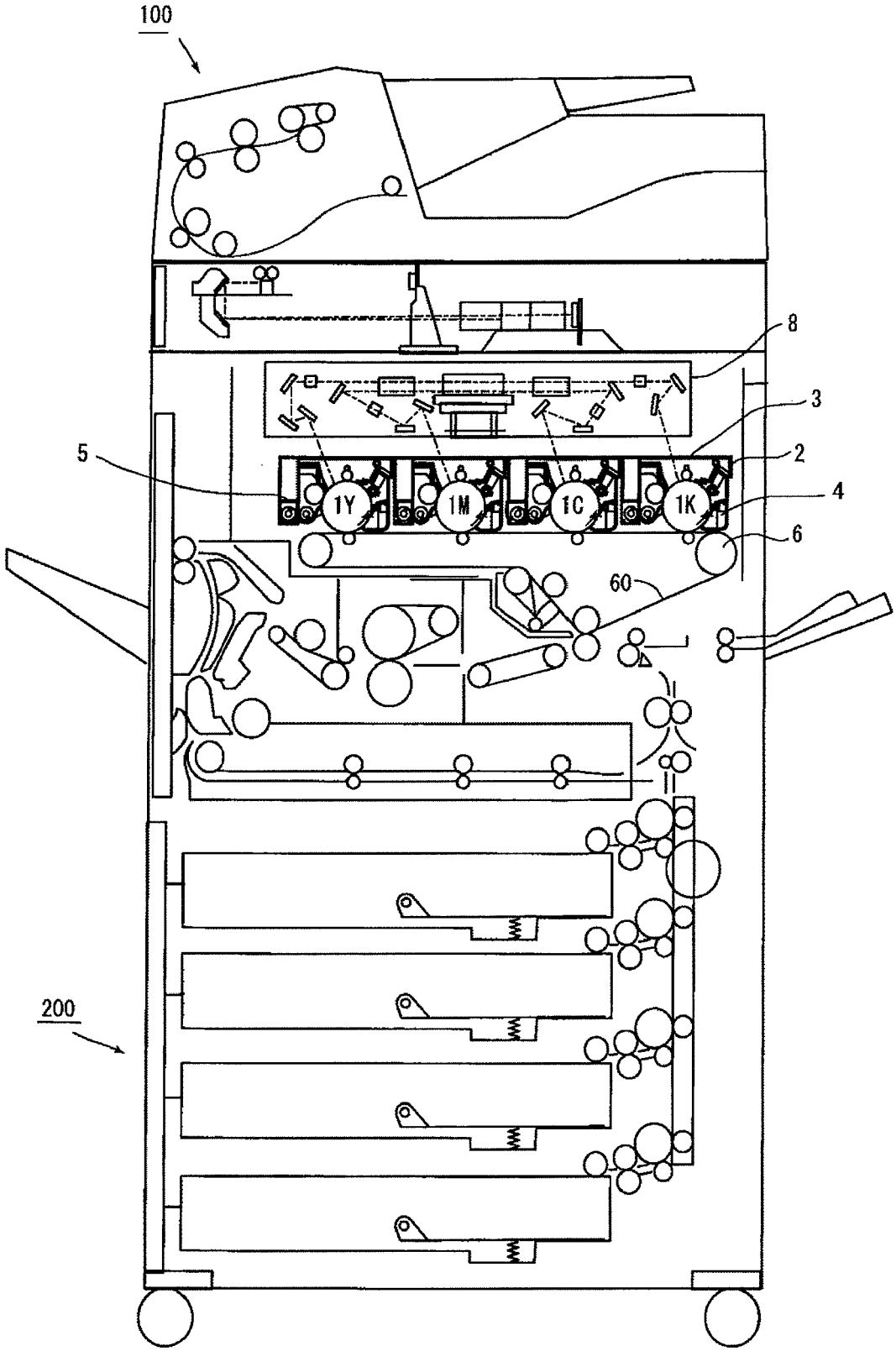
FIG. 4 is a drawing showing an example of an image forming apparatus to which the protective layer forming device shown in FIG. 2 is applied.

FIG. 3 is a drawing showing the structure of a process cartridge incorporating the above-mentioned protective layer forming device. The process cartridge shown in FIG. 3 is provided in each of color-by-color image forming stations so as to be applied to a tandem-type full-color image forming apparatus as shown in FIG. 4.

In the process cartridge, the following are housed together: a protective layer forming device 2; a photoconductor drum 1 as an image bearing member; and a charging device 3, a cleaning device 4 and a developing device 5 which are situated in the vicinity of the photoconductor drum 1 and used for an image forming process. On a part of the photoconductor drum 1, a transfer belt 7 which can pass through a transfer nip formed by the photoconductor drum 1 and a transfer device 6 is positioned.

In FIG. 3, the protective layer forming device 2, provided facing the photoconductor drum 1 serving as an image bearing member, is mainly composed of an image-bearing member protecting agent 21, a protecting agent supply member 22, a pressing force providing mechanism 23, a protective layer forming mechanism 24, etc. as described above.

Toner components, an image-bearing member protecting agent which has partially degraded, etc. remain on the surface of the photoconductor drum 1 after a transferring step; such residual matter on the surface is cleaned off by a cleaning member 41.

In FIG. 3, the cleaning member 41 is in contact with the photoconductor drum 1 at an angle related to a so-called counter type (reading type).

The image-bearing member protecting agent 21 is supplied from the protecting agent supply member 22 onto the surface of the image bearing member from which the residual toner, the image-bearing member protecting agent having degraded and the like have been removed by the cleaning mechanism 4, and a protective layer in the form of a film is formed by the protective layer forming mechanism 24. On this occasion, the image-bearing member protecting agent used in the present invention has very favorable adsorbability to parts on the surface of the image bearing member that are higher in hydrophilicity owing to electrical stress; therefore, even if the surface of the image bearing member starts to partially degrade owing to great electrical stress temporarily applied, adsorption of the protecting agent makes it possible to prevent the degradation of the image bearing member itself from progressing.

The photoconductor drum 1 on which the protective layer has been formed is charged, then a latent electrostatic image is formed on the photoconductor drum 1 by laser exposure or the like. The latent electrostatic image is developed by the developing device 5 and thusly visualized, and the visualized image is transferred onto the transfer medium 7 by a transfer device 6 or the like placed outside the process cartridge.

FIG. 4 is a cross-sectional view showing an example of an image forming apparatus 100 using the process cartridge shown in FIG. 3.

In FIG. 4, a protective layer forming device 2, a charging device 3, a latent image forming device 8, a developing device 5, a transfer device 6 and a cleaning device 4 are placed in the vicinity of a drum-shaped image bearing member 1, and an image is formed by the following operation.

Here, a series of processes for image formation, employed as negative-positive processes, is explained.

The image bearing member 1 typified by a photoconductor with an organic photoconductive layer (OPC) is subjected to charge elimination by a charge-eliminating lamp (not shown) or the like, then the image bearing member 1 is negatively charged in a uniform manner by the charging device 3 having a charging member.

When the image bearing member 1 is charged by the charging device 3, a voltage of appropriate intensity or a charged voltage made by superimposing an AC voltage onto the voltage, which is suitable for charging the image bearing member 1 to a desired electric potential, is applied from a voltage applying mechanism (not shown) to the charging member.

On the charged image bearing member 1, a latent image is formed utilizing a laser beam applied by the latent image forming device 8 based upon a laser optical system or the like (the absolute value of the electric potential of the exposed portion is smaller than that of the electric potential of the unexposed portion).

The laser beam is emitted from a semiconductor laser, and the surface of the image bearing member 1 is scanned in the direction of the rotational shaft of the image bearing member 1, using a multifaceted mirror of a polygonal column (polygon) or the like which rotates at high speed.

The latent image thus formed is developed with a developer which is made of toner particles or a mixture of toner particles and carrier particles, supplied onto a development sleeve that is a developer bearing member provided in the developing device 5, and a visible toner image is thereby formed.

When the latent image is developed, a voltage of an appropriate intensity or a developing bias made by superimposing an AC voltage onto the voltage is applied from the voltage applying mechanism (not shown) to the development sleeve, with the intensity being between the intensities of the voltages for the exposed portion and the unexposed portion of the image bearing member 1.

Toner images formed on image bearing members 1Y, 1M, 1C and 1K are transferred onto an intermediate transfer medium 60 by the transfer device 6, and then transferred onto a transfer medium such as paper fed from a paper feed mechanism 200.

On this occasion, an electric potential having the opposite polarity to the polarity of the toner charging is preferably applied to the transfer device 6 as a transfer bias. Thereafter, the intermediate transfer medium 60 is separated from the image bearing member 1, and a transfer image is thus obtained.

Toner particles remaining on the image bearing member are swept into a toner recovery chamber inside the cleaning device 4 by the cleaning member 41 and thusly recovered.

As the image forming apparatus, an apparatus may be employed in which the above-mentioned developing device is provided in a plurality of places, a plurality of toner images having different colors, sequentially produced by the plurality of developing devices, are sequentially transferred onto a transfer material, and then the toner images are conveyed to a fixing mechanism and fixed by means of heat or the like; alternatively, an apparatus may be employed in which a plurality of toner images similarly produced are sequentially transferred onto an intermediate transfer medium, and subsequently these toner images are transferred onto a transfer medium such as paper at one time and then similarly fixed thereto.

The charging device 3 is preferably a charging device placed in contact with or close to the surface of the image bearing member. This makes it possible to greatly reduce the amount of ozone generated at the time of charging in comparison with corona dischargers using discharge wires, which are so-called corotron dischargers and scorotron dischargers.

It should, however, be noted that in a charging device which performs charging with a charging member placed in contact with or close to the surface of an image bearing member, since electric discharge is performed in the vicinity of the surface of the image bearing member as described above, there tends to be great electrical stress on the image bearing member. Use of a protective layer forming device utilizing the image-bearing member protecting agent of the present invention makes it possible to sustain the quality of an image bearing member over a long period of time without causing degradation of the image bearing member; hence, it is possible to greatly reduce temporal variation in the quality of images and variation in the quality of images caused by a use environment and thus to secure stable image quality.

EXAMPLES

Next, Examples of image-bearing member protecting agents according to the present invention will be explained.

In the Examples explained below, note that the term "part" means "part by mass", and that the particle diameter of a fatty acid metal salt (A) and the particle diameter of an inorganic lubricant (B) were each measured using the laser diffraction particle size distribution measuring apparatus SALD-2200 (manufactured by Shimadzu Corporation) and the value of $D_{50}$ was defined as the average particle diameter of each of them.

Here, $D_{50}$ denotes the cumulative mass particle diameter which means the particle diameter when the cumulative mass is 50% by mass.

First of all, a production example of image-bearing member protecting agents is explained based upon Table 1.

TABLE 1

| | Fatty acid metal salt (A) | Particle diameter Da of fatty acid metal salt (μm) | Amount (part) | Inorganic lubricant (B) | Particle diameter Db of inorganic lubricant (μm) | Amount (part) | Db/Da |
|---|---|---|---|---|---|---|---|
| Protecting agent 1 | Calcium stearate | 300 | 80 | Molybdenum disulfide | 15 | 20 | 0.05 |
| Protecting agent 2 | Calcium stearate | 300 | 85 | Graphite | 8 | 15 | 0.03 |
| Protecting agent 3 | Calcium stearate | 300 | 80 | Talc | 30 | 20 | 0.10 |
| Protecting agent 4 | Calcium stearate | 300 | 90 | Talc | 30 | 10 | 0.10 |
| Protecting agent 5 | Calcium stearate | 100 | 80 | Boron nitride | 16 | 20 | 0.16 |
| Protecting agent 6 | Calcium stearate | 100 | 80 | Boron nitride | 5 | 20 | 0.05 |
| Protecting agent 7 | Zinc stearate | 400 | 70 | Boron nitride | 16 | 30 | 0.04 |
| Protecting agent 8 | Zinc stearate | 100 | 80 | Boron nitride | 16 | 20 | 0.16 |
| Protecting agent 9 | Zinc stearate | 100 | 80 | Boron nitride | 5 | 20 | 0.05 |
| Protecting agent 10 | Zinc stearate | 20 | 80 | Boron nitride | 5 | 20 | 0.25 |
| Protecting agent 11 | Zinc stearate | 6 | 80 | Boron nitride | 0.5 | 20 | 0.08 |
| Protecting agent 12 | Zinc stearate | 400 | 80 | Boron nitride | 5 | 20 | 0.01 |
| Protecting agent 13 | Zinc stearate | 20 | 80 | Molybdenum disulfide | 15 | 20 | 0.75 |

TABLE 1-continued

| | Fatty acid metal salt (A) | Particle diameter Da of fatty acid metal salt (μm) | Amount (part) | Inorganic lubricant (B) | Particle diameter Db of inorganic lubricant (μm) | Amount (part) | Db/Da |
|---|---|---|---|---|---|---|---|
| Protecting agent 14 | Zinc stearate | 20 | 80 | Talc | 30 | 20 | 1.50 |
| Protecting agent 15 | Zinc stearate | 6 | 80 | Boron nitride | 5 | 20 | 0.83 |
| Protecting agent 16 | Zinc stearate | 100 | 80 | Boron nitride | 45 | 20 | 0.45 |

As to each of the compositions for the protecting agents 1 to 16 shown in Table 1, a fatty acid metal salt (A) and an inorganic lubricant (B) were mixed together with the mixture ratio (based upon mass) shown in the table.

They were mixed together twice at a rotational speed of 25,000 rpm for 10 sec each time, using the crusher WONDER BLENDER WB-1 (available from OSAKA CHEMICAL Co., Ltd.), and a mixture powder body as a sample was thus produced.

Next, each of the compositions for the protecting agents 1 to 16 was poured into an aluminum mold having a depth of 20 mm, a width of 8 mm and a length of 350 mm, and the surface thereof was smoothed with a spatula; afterward, each composition filling the mold was compressed with a pressing die so as to have a height of 8 mm, and a compressed powder body was thus produced. On this occasion, the mass of each composition in powder form poured into the mold was adjusted such that the filling rate of the compressed powder body became 90%. (Mass of composition poured=Volume of mold×True specific gravity of composition×0.9)

Further, the compressed powder body, together with the mold, was increased in temperature to 95° C. using a hot plate, then heated and sintered while kept in the temperature range of 94° C. to 96° C. for 20 min, and subsequently, naturally cooled to room temperature.

After cooled, each of the solid compositions for the protecting agents 1 to 16 was removed from the mold, formed into a 8 mm×8 mm×310 mm shape and then attached to a metal support with the use of a two-sided adhesive tape, and the image-bearing member protecting agents 1 to 16 were thus produced.

Example 1

In the vicinity of a drum-shaped image bearing member (photoconductor) of 40 mm in outer diameter, there were a cleaning blade of counter type, a brush-like protecting agent supply member, and a protective layer forming mechanism of counter blade type provided in this order as seen from the upstream side, next to members for the transferring step; and a process cartridge which had a protective layer forming device using the protecting agent 1 in the production example was produced. A hard resin roller having a diameter of 12 mm was used as a charging member, and the gap between the charging member and the photoconductor was adjusted to 50 μm.

The process cartridge was installed in the color copier MFP IMAGIO MP C3500 (manufactured by Ricoh Company, Ltd.) which had been modified so as to be able to incorporate the process cartridge, and a test was carried out in which images were continuously formed on 80,000 sheets of A4 size paper with an image area ratio of 6%. As for a charging condition, an alternating electric field made by superimposing a sine wave (Vpp=3 kV, frequency=1.5 kHz) as an AC component onto a DC component of −600 V was applied. After the test, the image bearing member was measured for the amount of abrasion and visually observed for filming thereon. Further, the image quality after the test was confirmed in a low-temperature and low-humidity environment of 10° C. and 15% (RH) and in a high-temperature and high-humidity (HH) environment of 32° C. and 80% (RH), and whether or not cleaning failure in the low-temperature and low-humidity environment and blurring of images in the high-temperature and high-humidity environment had arisen was examined.

Example 2

Evaluations were carried out in a manner similar to Example 1, except that the protecting agent 2 was used instead of the protecting agent 1.

Examples 3 and 4

Evaluations were carried out in a manner similar to Example 1, except that the protecting agent 3 (for Example 3) and the protecting agent 4 (for Example 4) both containing talc were used instead of the protecting agent 1 in order to examine an effect (which is equivalent to the effect of claim 2) produced by using a specific substance for the inorganic lubricant (B).

Examples 5 and 6

Evaluations were carried out in a manner similar to Example 1, except that the protecting agent 5 (for Example 5) and the protecting agent 6 (for Example 6) both containing boron nitride were used instead of the protecting agent 1 in order to examine an effect (which is equivalent to the effect of claim 2) produced by using a specific substance for the inorganic lubricant (B).

Examples 7 to 12

Evaluations were carried out in a manner similar to Example 1, except that the protecting agents 7 to 12 (for Examples 7 to 12 respectively) all containing zinc stearate were used instead of the protecting agent 1 in order to examine an effect (which is equivalent to the effect of claim 3) produced by using zinc stearate for the fatty acid metal salt (A).

Example 13

In the vicinity of a drum-shaped image bearing member (photoconductor) of 40 mm in outer diameter, there were a brush-like protecting agent supply member, and a protective layer forming mechanism serving also as a cleaning blade of counter type provided in this order as seen from the upstream side, next to members for the transferring step; and a process cartridge which had a protective layer forming device using the protecting agent 10 in the production example was produced.

The process cartridge was installed in the color copier MFP IMAGIO MP C3500 (manufactured by Ricoh Company, Ltd.) which had been modified so as to be able to incorporate the process cartridge, and a test was carried out in which images were continuously formed on 80,000 sheets of A4 size paper with an image area ratio of 6%. Evaluations were carried out in a manner similar to Example 1.

Comparative Examples 1 to 4

Evaluations were carried out in a manner similar to Example 1, except that the protecting agents 13 to 16 (for Comparative Examples 1 to 4 respectively) which were outside the formulation range of the present invention were used instead of the protecting agent 1.

With the above-mentioned structure, an experiment was carried out in which to examine the amount of abrasion of the photoconductor, the existence or non-existence of filming, cleaning failure in a low-temperature and low-humidity environment and in a high-temperature and high-humidity environment, and blurring of images, at the time when the images had been formed on the 80,000 sheets of paper. The results are shown in Table 2.

TABLE 2

| | Characteristics after image formation on 80,000 sheets of paper | | | |
|---|---|---|---|---|
| | Amount of abrasion of photoconductor (μm) | Filming | Cleaning failure in LL environment | Cleaning failure in HH environment |
| Example 1 | 1.8 | B | C | B |
| Example 2 | 2.0 | B | B | C |
| Example 3 | 2.1 | B | A | B |
| Example 4 | 2.1 | B | A | B |
| Example 5 | 1.8 | B | A | B |
| Example 6 | 1.5 | B | A | B |
| Example 7 | 1.0 | B | A | A |
| Example 8 | 1.0 | B | A | A |
| Example 9 | 1.0 | A | A | A |
| Example 10 | 0.7 | A | A | A |
| Example 11 | 0.8 | A | A | B |
| Example 12 | 1.1 | A | B | A |
| Example 13 | 1.2 | A | B | A |
| Comparative Example 1 | 4.2 | C | D | D |
| Comparative Example 2 | 2.8 | D | D | D |
| Comparative Example 3 | 4.0 | C | D | C |
| Comparative Example 4 | 2.2 | D | D | C |

In Table 2, A denotes "excellent", B denotes "not problematic in practical use", C denotes "acceptable" and D denotes "impossible to use".

As is evident from Table 2, it has turned out that when any of the image-bearing member protecting agents according to the present invention is used, blurring of images and cleaning failure can be reduced over a long period of time. What makes this happen will be clearly understood in the future as analysis proceeds; as described above, although it is not possible to identify the exact cause of the phenomenon, it is inferred that when particles of the boron nitride are dispersed between large particles of the zinc stearate and compressed, the particles of the boron nitride enter gaps between the particles of the zinc stearate, and that there is an appropriate diameter range for the particles of the boron nitride to fill these gaps and temporal variation in consumption is reduced when these gaps are evenly filled. Thus, it is possible to obtain stable images of high quality by reducing, over a long period of time, blurring of images and cleaning failure caused by leakage of toner between a blade and the photoconductor surface.

It has turned out that by specifying the inorganic lubricant (B), it is possible to maintain superior effects on cleanability, especially in a low-temperature and low-humidity (LL) environment.

Hence, the occurrence of abnormal images can be prevented by securing protection for the surface of the image bearing member over a long period of time; moreover, since the charging device can be prevented from being smeared by reducing the amount of leaking toner, it is possible to reduce the occurrence of charging unevenness and thus to prevent the occurrence of anomalies such as density unevenness.

What is claimed is:

1. An image-bearing member protecting agent used for forming a protective layer on a surface of an image bearing member, the agent comprising:

a compressed powder body formed by pressurizing a powder containing at least a fatty acid metal salt (A) and an inorganic lubricant (B), wherein a ratio Db/Da of an average particle diameter Db of the inorganic lubricant (B) to an average particle diameter Da of the fatty acid metal salt (A) satisfies $0<Db/Da\leqq 0.40$.

2. The image-bearing member protecting agent according to claim 1, wherein the inorganic lubricant (B) is at least one selected from the group consisting of talc, mica, boron nitride and kaolin.

3. The image-bearing member protecting agent according to claim 1, wherein the fatty acid metal salt (A) is zinc stearate.

4. A process cartridge comprising:

an image bearing member, a protective layer forming device, and at least one of a charging device, a developing device and an image-bearing member cleaning device, which subject the image bearing member to an image forming process, wherein the protective layer forming device is provided in a post-cleaning position in the moving direction of the image bearing member, wherein the protective layer forming device applies or attaches an image-bearing member protecting agent onto a surface of the image bearing member, wherein the image-bearing member protecting agent is used for forming a protective layer on the surface of the image bearing member, the agent comprising a compressed powder body formed by pressurizing a powder containing at least a fatty acid metal salt (A) and an inorganic lubricant (B), and wherein a ratio Db/Da of an average particle diameter Db of the inorganic lubricant (B) to an average particle diameter Da of the fatty acid metal salt (A) satisfies $0<Db/Da\leqq 0.40$.

5. The process cartridge according to claim 4, wherein a blade member which is in contact with the image bearing member is used for the image-bearing member cleaning device.

6. An image forming apparatus comprising:

a process cartridge which comprises an image bearing member, a protective layer forming device, and at least one of a charging device, a developing device and an image-bearing member cleaning device, which subject the image bearing member to an image forming process, wherein the protective layer forming device is provided in a post-cleaning position in the moving direction of the image bearing member, wherein the protective layer forming device applies or attaches an image-bearing member protecting agent onto a surface of the image bearing member, wherein the image-bearing member protecting agent is used for forming a protective layer on the surface of the image bearing member, the agent comprising a compressed powder body formed by pressurizing a powder containing at least a fatty acid metal salt (A) and an inorganic lubricant (B), and wherein a ratio Db/Da of an average particle diameter Db of the inorganic lubricant (B) to an average particle diameter Da of the fatty acid metal salt (A) satisfies $0<Db/Da\leqq 0.40$.

7. The image forming apparatus according to claim 6, wherein the process cartridge is provided in a plurality of places so as to constitute color-by-color image forming stations.

* * * * *